United States Patent [19]

Singh et al.

[11] Patent Number: 4,875,900

[45] Date of Patent: Oct. 24, 1989

[54] METHOD OF TREATING LEATHER

[76] Inventors: Vir B. Singh, 6, Rutland Gate, Madras-600008; Kanniah N. G. K. Moorthy, 29, North Railway Station Road, Thiruvothiyur; Madras-600019; Pushpendar K. Kaushik, L-42/K, Bharthi Dasan Colony, K.K. Nagar, Madeas-600078; Hariharan Sankarasub-Ramanian, 2A Bala Krishna Naicken Street, West Mambalam, Madras-600033, all of India

[21] Appl. No.: 99,780

[22] Filed: Sep. 22, 1987

[51] Int. Cl.[4] ..... C14C 3/06

[52] U.S. Cl. ..... 8/94.27; 8/94.1 R; 8/94.23; 8/94.33

[58] Field of Search ..... 8/941 R, 94.18, 94.23, 8/436, 94.27, 94.33

[56] References Cited

FOREIGN PATENT DOCUMENTS 0720505 12/1954 United Kingdom ..... 8/94.18

*Primary Examiner*—Paul Lieberman

*Assistant Examiner*—John F. McNally

*Attorney, Agent, or Firm*—Kerkam, Stowell, Kondracki & Clark

[57] ABSTRACT

The invention relates to a method for treatment of leather for improving the chrome exhaustion and various other properties. The method consists in treating the leather with a dispersion microcrystalline polyamide or polyester. Such a treatment is carried out at the stage of tanning, rechroming, retanning or dyeing.

6 Claims, No Drawings

METHOD OF TREATING LEATHER

This invention relates to improvements in or relating to a method of treating leather and to an improved treated leather obtained therefrom.

PRIOR ART

It is generally known in the art that the hides and skins of animals are subjected to a plurality of chemical and physical treatments in order to impart the required physical and chemical properties to leather and so as to render it suitable for various applications.

As flayed hides and skins contain a high content of water, degradable protein and dirt, such hides and skins are liable to decay and putrification. In order to avoid such decay or putrification, the flayed hides and skins are subjected to the step of preservation by salting technique. The salted hides and skins are then subjected to a cleansing process which involves the steps of soaking, liming, de-liming bating and pickling, said cleansing steps being performed prior to the step of tanning.

The step of tanning consists in a chemical treatment employing either vegetable extracts or mineral tanning agents.

In the methods of tanning employing mineral tanning agents, the cleaned hides and skins are subjected to the widely known step of chrome tanning treatment. Such a treatment consists in employing chromium sulphate or chloride which, under acidic conditions, penetrate into the leather structure. The salts of chrome form a complex with carboxyl groups of protein during the subsequent step of basification. The step of chrome treatment is preferred to vegetable extract treatment, as it imparts better chemical and physical properties and, further, improves resistance to heat hydrolysis and microorganism. Although chrome tanning is preferred, it has in practice been found that only 70–75% of chrome is fixed to leather and that the remainder of 25–30% goes into the effluent. Such a loss or depletion of chrome results in substantial ensuing disadvantages, as it is generally believed that greater the amount of chrome fixed to leather, better are the chemical, physical and heat resistance properties. Furthermore, the loss of 25–30% of chrome adds to the end costs of the process. Yet another ensuing disadvantage is that the chrome leaving the leather matrix or surface enters the effluent and causes serious pollution problems.

Besides chrome, other tanning agents such as chromium aluminium syntans, titanium or zirconium have been suggested in the art. Though such agents have been suggested, the use of chrome as a tanning agent is still generally employed by the industry.

In the step of vegetable extract tanning, the hides and skins are treated with vegetable extracts and that the treated leather is generally known as EI tanned leather.

Subsequent to the step of tanning by treatment with chrome salts, the treated leather is subjected to the step of basification where cross linking of chrome with carboxyl group of the collagen takes place. Such a treated leather is known in the art as wet blue leather. As the wet blue leather has only a limited amount of chrome fixed to it, the leather is subjected to the step of rechroming which consists in a treatment with chromium salts and basification so that a greater amount of chrome may be fixed to the leather.

The wet blue leather is neutralised to PH 4,5–5.6 to make it ready for fatliquoring and dyeing processes.

Neutralisation is done to convert the surface charge of the leather from Cationic to anionic which otherwise causes the dyes and fatliquors to precipitate on the surface.

Thereafter, the leather is subjected to the step of retanning. The purpose of retanning is to impart specific properties to the leather. Retanning fills the empty structure, corrects the variation in the thickness, levels surface defects and, further, helps in better dye penetration.

Such a retanning step is intended to improve general feel, thickness, strength, chemical resistance, heat resistance, buffability, fullness and dye-uptake properties. However, in practice it has been found that such properties do not substantially improve. Number of syntans are used during retanning process. The type of syntans, used are phenolformaldehyde, naphthalene sulphonic acid, acrylic and urea formaldehyde, chrome aluminium and sirconium based. Sometimes reactive fillers, mica and silica are used to achieve specific properties.

During or subsequent to the step of retanning, the leather is also subjected to the steps of dyeing and fatliquoring. It has been found that the step of fatliquoring improves the properties of softness, strength, suppleness, stretch and flexibility.

OBJECTS OF INVENTION

A primary object of this invention is to propose a method for the treatment of leather in order to impart improved properties of sharp dye tone, satisfactory dye penetration, grain lubrication, softness, suppleness, stretch, flexibility and strength characteristics.

Another object of this invention is to propose a method for the treatment of leather in order to impart improved properties of feel, chemical, heat resistance and fullness.

A further object of this invention is to propose a method for the treatment of leather which prevents a substantial depletion of chrome from the treated leather, and, thereby, reduce the problem of effluent pollution.

DETAILED DESCRIPTION OF THE INVENTION

According to this invention there is provided an improved process for the treatment of leather by the known steps including those of tanning, rechroming, retanning and dyeing characterized in the step of treating the leather with an aqueous dispersion of polyamide and/or polyester.

Specifically in accordance with the present invention, the step of tanning, rechroming, retanning and/or dyeing is carried out in the presence of an aqueous dispersion of a polyamide and/or polyester material. The said polymer particles employed in the dispersion have preferably a size of 2 microns and less. It has been found that particles of a larger size do not effectively penetrate into the pores of the leather. Simultaneously, it is to be understood that a reference made herein to a dispersion containing said polymer particles also includes particles of different sizes, and where a majority of such particles present in the dispersion have a size of 2 microns and less.

Strangely, it has now been found that such a treatment with an aqueous dispersion of polyamide and/or polyester considerably improves the properties of leather. Thus, and in the instance where such a treatment is carried out with the step of chrome tanning and/or rechroming, the depletion of chrome from the leather substantially reduces and, whereby, chrome fixation increases. Such an increase in chrome fixation or a reduction in the depletion of chrome is of substantial advantage in that the properties of feel, thickness, strength, chemical and heat resistance, fullness and dye-uptake substantially improves. Yet another advantage and of equal importance is that due to a reduction in the depletion of chrome, the amount of chrome in the effluent is reduced and, whereby, the problems of pollution is reduced. If such a treatment with the polyamide and/or polyester dispersion is carried out at the step of retanning, it has been found that the dyeing properties improve using the same amount of dye as with the known process or that the same shade is obtained using a lesser amount of dye.

The theoretical aspect or the manner in which the polymer dispersion reduces the depletion of chrome from leather is still to be ascertained. However, the chrome fixation in the leather by the use of polyamide dispersion of the present invention is increased to 95% and resulting in the advantages referred to hereinabove.

Without implying any limitation or restriction, it is believed that such an increase in the chrome fixation and the advantages referred to hereabove may be attributed to the reasons described hereinbelow.

Chrome tannage is a cross linking reaction between carboxyl groups of the collagen molecules and chromium salt. The hide protein can be considered as a co-ordinate legend. The carboxyl group, when ionised, is attracted to the chromium tanning complex and a reaction takes place. The fixation of chromium by protein increases with the increased ionisation of the hide protein carboxyl groups and the fixation increases from zero at pH less than 3 to a maximum at pH. 4. As the polymer dispersion of the present invention also consists of same reacting groups as protein molecule i.e. carboxyl and amino groups, they possibly react exactly in the same way with chromium as protein.

In chrome tanning there are four competing reactions taking place simultaneously. These are all reactions between coordinating legends on the chromium complex. The relative dominance of each reaction is controlled by the adjustment of pH, temperature and concentration.

The four reactions are:

1. The reaction between the OH group and the chromium i.e. basicity

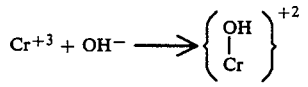

2. The reaction between cation of the chromium compound and sulfate.

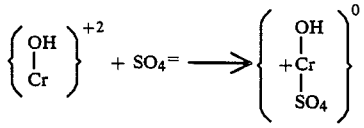

3. The reactivity of masking agents such as formate

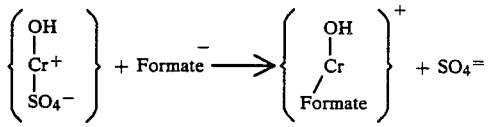

4. The reactivity of hide protein

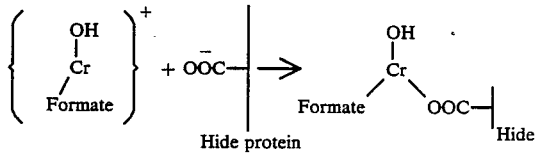

or

OOC—Polyamide— or both

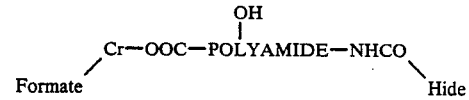

At low pH, concentration of OH in the solution is low, and the basicity of chromium is also low. The first reaction takes place as the pH is increased. The chromium salt solution penetrates through the leather freely at low pH. As the dispersion of the present invention contains polymer of a small particle size, it also penetrates through the leather microstructure. Thus, presence of the polymer dispersion provides additional carboxyl groups for complex formation.

The coordination of sulphate is not strongly affected by pH, and sulphate will be present in the complex at low pH. Reaction two is not directly affected by pH since $SO_4$ is a strong ion and remains reactive with protein over a wide pH range of practical tanning. The masking agents may be coordinated with chromium at low pH provided they are sufficiently ionised. This reaction is dependent on the nature of acid pH as higher pH favour reactivity. At low pH the hide protein has very little reactivity with chromium. The carbonyl groups of the protein in the dispersion react in a manner similar to weak acid, and are more affected by pH change. As the pH is increased, the basicity increases and more OH groups enter the complex. The masking agents remain coordinated with the chromium at this stage. The reactivity of the protein is greatly increased with increased pH and the initial tanning reaction is accomplished. The presence of carboxyl groups in the dispersion assists in forming bigger complex with chromium. Thus, it is believed that instead of chromium protein reaction, the reaction takes place between carboxyl groups of the dispersion-chromium-protein and a bulky molecular structure results. This helps in filling the structure more fully and at the same time being cross linked structure increases the strength of the leather. The leather becomes more full without losing strength or area. In fact, observations show that both properties improve and possibly area increase also takes place. Further, and when the polymer consists of a polyamide, the unused amino group helps in interacting with dyes and an intense an tone to tone dye effect is obtained.

The types of polyamide material that can be employed in the process of this invention is selected from materials, such as Nylon 6, Nylon 66, Nylon 10, Nylon 7, Nylon 11, Nylon 12 or mixtures of any two or more of these materials. Other suitable materials also include copolymers or terpolymers containing mixed diamines and dibasic acids or lactums. Yet another source of this material is Nylon waste or Nylon fibres. Similarly, polyester waste, chips or fibres can form certain of the sources for the polyester to be employed in the dispersion. Similarly, a mixture of polyester and polyamide may be employed in the dispersion.

The concentration of the polymer in the dispersion is not considered critical or important in order to achieve the desired properties. However, if the solid content in the dispersion is greater than 50%, then the dispersion may be too viscous.

The required aqueous dispersion of polyamide is obtained by subjecting the polymide to a step of hydrolisation with excess of mineral acid at temperature of 50° to 150° C. The hydrolised material is washed with water. The material having a pH of 2 to 8, and preferably a pH of 2 to 4.5 is subjected to a step of attrition, while held in water so as to obtain a fine dispersion of the polymer in water, the polymer particles in the said suspension being of a particle size of 2 microns and less. It has been that such a method of preparation and without the addition of a swelling agent provides a dispersion having the aforesaid particle size of the polymer.

The invention will now be more fully described with reference to the ensuing examples and where Examples 1–3 show the process of preparation of microcrystaline polyamide. Example 4 relates to the preparation of micro-crystaline polyester; and Examples 5 to 12 relate to the use of the polyamide dispersion for treatment of leather. Though Examples 5 to 12 relate only to a polyamide dispersion, it is to be understood that similar results were obtained by the use of a polyester dispersion. Furthermore and for purposes of brevity the examples are limited to only certain types of leather, it being understood that the said method can equally apply to other types of leather.

The invention is not described by giving examples:

EXAMPLE 1 Preparation of Microcrystalline Polymers from Nylon-6.

In a 10 liters round bottomed flask fitted with a variable speed stirrer, reflex condenser, temperature controller and heating system 6000 ml of 10% hydrochloric acid was charged. 3600 gms of Nylon chips (polyamide) having a viscosity molecular wt. of 20,000 were then charged to the vessel. While stirring the mass at 100 r.p.m. temperature of the vessel was gradually raised to 75° C.±2° C. This temperature was maintained for a period of 8 hours. The completion of the hydrolysis reaction was judged by crushing the chips between fingers or between two glass slides. The material was discharged in a centrifuge. Unreacted Hcl was drained off and chips were washed till free from acidity. Neutralised chips were analysed for relative viscosity, mol. wt. amine and carboxyl end groups.

Washed chips were subjected to attrition in an attritor mill. Demineralised water was added to adjust the grinding viscosity. For example for 1 Kgs. of wet chips, 1.5 K.gms. of Dimineralised water was added. The attritor mill was operated at 200 r.p.m. for nearly 2 hours. After the attrition further 0.5 kg of water was added, mixed well and then sieved through a 100 mesh to remove grinding media.

The polymer obtained was characterised by mol. wt., relative viscosity and end group analysis. The results obtained are given in below.

Mol. Wt. 4200
Relative viscosity
(1% solution in 96% $H_2SO_4$) 1.35±0.05
$NH_2$ Group 0.25
COOH Group 0.25
Density 1.14

EXAMPLE 2

Polymer from Nylon 66:

The chips had relative viscosity of 2.70 and viscosity average molecular weight of 18,000. Same procedure as in example-1 was followed for hydrolysis. Nylon 66 chips 3.6 kgs were charged in the reaction vessel containing 6 liters of 10% Hcl. The vessel was heated 75° C. and reaction was carried out for 6 hours. The chips were discharged. Acid was drained, and chips washed, attrited and dispersion obtained was analysed. The dispersion had solid content of 20% and particle size less than 2 microns.

EXAMPLE 3

Polymer from Nylon yarn waste material:

Viscosity average: 22500
Molecular Weight
Nylon yarn of relative viscosity 3.30 was taken.

In an equipment as in example - 11.8 Kgs. of compacted Nylon Yarn waste was hydrolysed with 6 liters of 10% hydrochloric acid. The hydrolysis was done at 75° C. for 6 hours. THe yarn waste chips were washed to neutral point, attrited to a fine suspension.

The suspension characteristics as given were found:
Appearance—Milky white.
Solids—25±3%
Particle size less than 2 microns
Brookfield visc. of suspension 8000cps.

EXAMPLE 4

Preparation of Microcrystalline Polymers from Polyester Polymers.

In a 2 liter autoclave fitted with a variable speed stirrer, temperature controller and heating system 100 gm polyester granules, 21 ml. n-propylamine, 21 ml. of ethyleneglycol and 1620 ml. of demineralised water was charged. Prior to charging, polyester granules were dried at 150° C. under nitrogen atmosphere. The stirrer r.p.m. was maintained at 300. Temperature was gradually raised to 150° C. The pressure inside the vessel was kept 0–8.5 kg/sq.cm. The pressure inside and pressure was maintained for 2 hours. After the reaction the hydrolysed material was discharged in water under pressure and allowed to cool to room temperature. It was washed to neutral pH, filtered and dried. The yield was 80%. The microcrystalline polyester obtained was attrited for 6 hours. The polyester properties were as follows:

Melting Point: 237° C.
Colour: White

Dispersion prepared from micro-crystalline polyester consisted of 26% w/w solids at particle size of 85‰ of less than 2 microns.

Molecular Weight: 8000

Relative Viscosity: 1.41
(Phenol:tetrachlorethylene=1:1)
pH: 6–7
COOH: 0.40
Brookfield viscosity of dispersion: 265 cps.

EXAMPLE 5

Use of Polymer of example 1 as a chrome exhausting aid in buff calf leathers. The polyamide dispersion prepared in example - 1 was used in leathers at the *chrome tanning stage.*

The process is given below:
Type of leather Buff Calf
Pelt. Wt. 3750 Kg.
After Pickling - Pickle $P^H$ 2.5
Chrome Powder 4%
Water 40.0% —Run for 30'
Polymer dispersion for example 1 5.0% —Run for 30'
Chrome Powder 4.00 —Run for 30'
Sodium Sulphite 4 feeds Run for 60'
Basify by Sodium bicarbonate 0.5% —4 feeds.
$p^H$ 4.0

The leathers were subjected to bleaching, washing and retanning, dyeing and fatliquoring, and finishing processes in the usual way. The results of chromium oxide analysis by the process of the present invention were compared with the known process and were was follows:

| | $Cr_2O_3$ content in Leather | $Cr_2O_3$ Content in effluent |
|---|---|---|
| Known | 4.37% | 1.21% |
| Example 5 | 5.15% | 0.43% |

The results showed that more chrome is fixed in leather an d less chromium goes out in the effluent when Polyamide dispersion is used in the process.

Fullness, Dye characteristics, strength, properties feel were better than control when polyamide dispersion of this invention is used.

EXAMPLE 6

Use of Polymer of this invention in rechroming stage
Type of leather Buff Calf
Wt. of leather 110 Kg.

| | | |
|---|---|---|
| Stripping | | |
| Water | 150% | Run for 60' |
| Sodium Sulphite | *1% | |
| Soda bicarbonate | 0.75% | |
| Drain | | |
| Washing & Degreasing | | |
| Water | 125% | Run for 45' |
| Degreasing Agent | 1.5% | |
| Drain and Wash | | |
| Bleaching | | |
| Water | 125% | Run for 60' |
| Oxalic Acid | 1.5% | |
| Drain | | |
| Chrome Tanning | | |
| Water | 125% | Run for 90' |
| Formic Acid | 0.1% | |
| Amphoteric dispersant | 0.25% | |
| Chrome Powder | 3.0% | |
| Polymeric dispersion of Example 1 | 4.0% | Run for 90' |
| Fat Liquor | 0.3% | |
| Preservative | 0.02% | |

-continued

| | | |
|---|---|---|
| Baysyntan CD (BASF) | 0.3% | Run for 90' |
| Anionic levelling agent | 0.3% | |
| Chrome Powder | 3.0% | |
| Baysyntan AN (BASF) | 2.0% | Run for 120' |
| Sodium Bicarbonate | 1.5% | |
| Wash PH 3.5 to 4 | | |

Leathers were washed, neutralised, dyed, fatliquored and finished in the usual way. The $Cr_2O_3$ content of the leathers were examined and found as below:

| | $Cr_2O_3$ Content in leather | $Cr_2O_3$ Content in effluent |
|---|---|---|
| Known Process | 2.46 | 0.24 |
| Process of Example 6 | 3.13 | 0.16 |

The above results show that no chrome is fixed when using the polymer dispersion of the present invention in comparison to that of the known art. The finished leather treated by the process of the present invention have superior fullness, smoothness and strength compared to those treated by the known process.

EXAMPLE 7

Use of Polymer dispersion of example 1 as a chrome exhausting aid in Cow hides at the chrome tanning stage.

Type of Leather: Cow hides
Pelt Weight: 2200 kg
After Pickling: Pickle PH 2.5
Basic Chrome Salt: 3.5% of Pelt wt.—Run for 60'
GLS: 2 % —Run for 15'
Polymer dispersion of example 1: 2% —Run for 35'
Sodium formate: 0.5% —Run for 15'
Basic Chrome Salt: 3.5% —Run for 60'
Water: 40%
Sodium Bicarbonate: 0.5 hours —Run for 4 hrs.
Check PH: 3.8
Preservative: 0.2% —Run for 30'

Leather and effluent sample were collected after basification and analysed for chromium oxide content and compared with the known process. The comparative results are as follows:

| | $Cr_2O_3$ Content in leather | $Cr_2O_3$ Content in effluent |
|---|---|---|
| Known Process | 3.72 | 0.46 |
| Example 7 | 4.86 | 0.74 |

The results showed that more chrome is fixed when polymer dispersion of this invention is used and chrome going in the effluent is considerably reduced.

The finished leather showed superior fullness, dye characteristics and strength properties and feel was better compared to control.

EXAMPLE 8

Use of Polymer dispersion of example 1 as a chrome exhausting aid at the rechroming stage of Goat suede.

| % of Ingredients added based on shaved weight of skins. | |
|---|---|
| Water | 150% - Run for 30' |
| Basic Chrome Salt | 7% - Run for 30' |
| Polymer dispersion of example 1 | 2% - Run for 60' |

-continued

| | |
|---|---|
| Basic Chrome Salt | 5% - Run for 30' |
| Polymer dispersion of example 1 | 2% - Run for 60' |
| Left overnight in the bath | |
| Next day drummed for 15 minutes | |
| Add Sodium Bicarbonate | 1.0% - Run for 60' |

After basification the leather samples and effluent were analysed for chrome content and compared with known process. Results are given below:

| | % $Cr_2O_3$ Content in leather | % $Cr_2O_3$ Content in effluent |
|---|---|---|
| Known Process | 3.99 | 0.68 |
| Example 8 | 4.63 | 0.21 |

The results showed that more chrome is fixed when polymer dispersion of this invention is used and chrome going in the effluent is considerably reduced.

The finished leather showed superior fullness, dye characteristics, buffability, nap, strength properties and feel compared to control.

EXAMPLE 9

Treatment of Semi Chrome Garment Leathers from vegetable tanned leathers with the dispersion of the present invention at the retanning stage.

Starting Materials: Vegetable tanned leathers of average area 4.5 sq. ft. Buff along the back bone to level the substance;

| | | |
|---|---|---|
| Wetting Back | 600% Water | |
| | 0.25% Sodium Lauryl Sulphate 45' | |
| | 10% water | |
| | Drain | |
| | Wash - twice | |
| Stripping | 300% Water | 15' |
| | 1% Borax | |
| | 10% Water | |
| | 0.5% Sodium Bicarbonate | 15' |
| | 10% Water | |
| Washing | 300% Water 15' | |
| Souring | 300% Water | |
| | 0.5% oxalic acid | 15' |
| | 10% water | |
| | 1% formic acid 30' | |
| | Check pH to 3.8–4.0 | |
| Chrome tanning | 8% Chrome extract | 30' + 30' + 30' |
| | 30% Water | |
| | Run 1 hour after last addition | |
| Basification | 1% Sod. formate | 15' |
| | 10% Water | |
| | 1.5% Sod. Bicarbonate | 15' + 15' + 15' |
| | 10% Water | |
| | Check pH to 3.8–4.0 - Drain | |
| Washing | 300% Water - 15' | |
| | 300% Water - 15' | |
| Neutralisation | 250% Water | 15' |
| | 1% Formate | |
| | 10% Water | |
| | 0.75% Bicarbonate | 30' |
| | 10% Water | |
| | pH of cut section 5.5 - Drain | |
| Washing | 300% Water - 15' | |
| | 300% Water - at 55° C. - 15' | |
| Retanning, Dyeing & Fatliquoring | 250% Water at 55° C. | 30' |
| | 2% Dye | |
| | 30% Water 30' | |
| | 2% Basynton DI (BASF) 30' | |
| | 5% Targotan LSI(SANDOZ)40'- 40' | |
| | 4% Vernaminal liquor ASN (Colour Chem.) | 40' |
| | 3% Vernol liquor PN (Colour Chem.) | |
| | 4% Vernol liquor SS (Colour Chem.) | |
| | 20% Water | |
| | 1% Formic Acid 10' | |
| | 10% Water | |
| | Drain | |
| | Pile overnight: Lightly set, hood dry, sawdust, stake, trim, buff on the flesh side with emery 180 paper. | |
| Finishing | 30 cc liquid dye solution 970 cc water apply one pad coat, dry. | |
| Season Coat | Black pigment 50 gm | |
| | Binder IM (Colour Chem) 75 cc | |
| | Eukasol Binder U (BASF) 50 gm | |
| | Lepton Wax FBA (BASF) 50 gm | |
| | Liquor ammonia 10 cc | |
| | Water to make 1 ltr | |
| | Spray two full cross coats, drying in between. | |
| Top Spray | NC Lacquer emulsion - 1 part | |
| | Thinner - 1 part | |
| | Spray one full cross coat, dry. | |
| | Plate at 60° C. and 25 kg/cm$^2$ | |
| Experiment | The processing for experiment was the same as for the known process but 5% Targotan LSI was replaced with 10% of polymer dispersion of example 1. | |

EXAMPLE 10

Clothing leathers from wet blue sheep skins and where the dispersion of the present invention is used at the retanning stage.

| | | |
|---|---|---|
| Wash | 100% Water | 15' |
| | 0.2% Acetic Acid | |
| Rechrome | 50% Water | |
| | 5% Chrome extract (Prebasified to 50% basicity) - 1 hr. | |
| | Check pH to 3.8–4.0 | |
| | Pile overnight | |
| Washing | I wash - 150% water 15' | |
| | II wash - 150% water 15' | |
| Neutralisation | 150% Water 15' | |
| | 1% Vernatan AKM 15' | |
| | 10% Water | |
| | 0.5 Sod. bicarbonate 15' + 15' + 15' | |
| | 10% Water | |
| | Check pH to 5.0–5.5. at cut section. | |
| Washing | 150% water 15' | |
| | 150% water at 55° C. - 15' | |
| Retanning & Fatliquoring | 40% water at 55° C. | 30' |
| | 6% Vernaminol liquor (Colour Chem) | |
| | ASN | |
| | 4% Vernol liquor SS (Colour Chem) | |
| | 4% Basyntan DI (BASF) | 30' |
| | 10% water | |
| | 1% formic acid | 5' + 5' + 20' |
| | 10% water | |
| | Drain Pile overnight | |
| | Lightly set, hook dry, saw dust, stake, toggle, buff, dust and weigh (Based on crust weight). | |

-continued

| | | |
|---|---|---|
| Wetting Back | 1000% Water<br>1% Nonionic wetting agent<br>1% ammonia | 60' |
| | Leave overnight<br>Run 30'<br>Drain | |
| Washing | 400% water 15' | |
| Dyeing | 250% water at 55° C. - 10'<br>1% Ammonia<br>3% Vernaminol liquor ASN (Colour Chem)<br>10% Water<br>2% Dye 30'<br>20% water<br>1% Formic Acid 5' 5' 20'<br>10% Water<br>Drain, rinse in hot water | |
| | 200% water<br>1% cationic fatliquor | 20' |
| | Drain, Pile overnight.<br>Lightly set, hook dry, sawdust, stake. | |
| Finishing | 100 gm pigment paste<br>25 gm was emulsion (BASF)<br>150 gm resin binder (CLRI)<br>40 gm protein binder<br>10 cc ammonia<br>30 gm Eukasol oil ground (BASF)<br>5 cc ammonia<br>Volume made up to 1 ltr. | |
| | Spray 11/2 cross coat, dry<br>Spray 1-11/2 cross coat for covering. | |
| Top Lacquering | 1 part lacquer emulsion<br>1 part water | |
| | Spray one full cross coat dry, hot plate at 60° C. at 25 kg/cm$^2$ | |
| Experimental | The process was the same as for the known process with modification during retanning and fatliquoring as follows:<br>50% water at 55° C.<br>10% Polymeric dispersion of example 1.<br>6% Vernaminol liquor ASN<br>2% Vernol liquor PN<br>20% water | 120' |
| | The Polymer dispersion of example 1 replaces 100% Basyntan DI. | |
| | 2% Basyntan DI<br>10% water | 30' |
| | 1% Formic Acid<br>10% water | 5' + 5' + 20' |
| | Drain, rinse, pile overnight, Dyeing, finishing etc. were the same as reported earlier. The leathers were visually assessed, physical tested and chemical analysis made and results are shown in Table 1. | |

EXAMPLE 11

Shoe suedes from wet blue goat skins

Starting material: Wet blue goat skins with fairly good substance and free from flay cuts and vein marks.

-continued

| Trim, weight (Based on wet blue weight) | | |
|---|---|---|
| Washing: | 150% water | |
| | 0.2% acetic acid | 15' |
| Rechroming: | 50% water<br>5% Cr extract (Prebasified to 50% basicity)<br>adjust pH to 3.8–4.0 | 1 hr. |
| | Pile overnight | |
| I washing: | 150% water | 15' |
| II washing: | 150% water | 15' |
| Neutralisation: | 150% water<br>1% vernatan AKM<br>10% water | 15' |
| | 1% Sodium bicarbonate<br>10% water | 15' + 15' + 15' |
| | Check pH at cut section to 5.5<br>Drain<br>Wash 150% water 15'<br>Wash 150% water 15' | |
| Retanning and Fatliquoring: | 60% water at 55° C.<br>4% Lipoderm FB II<br>2% Vernaminol liquor ASN (Colour Chem)<br>1% Vernol liquor SL (Colour Chem)<br>20% Water | 45' |
| | 4% wattle extract<br>10% water | 45' |
| | 4% Basyntan DI<br>10% water | 45' |
| | 2% Syntan ACR (Chennai Organic)<br>5% water | 30' |
| | Check exhaust<br>If not exhausted add | |
| | 1% formic acid<br>10% water | 5', 5', 20' |
| | Drain, pile overnight. Hook up to dry, sawdust, stake, buff on the flesh side with 180, 240 and 320 paper. Shave on the neck to level substance. Brush and weigh. (based on crust weight) | |
| | 1000% water at 55° C.<br>1% Ammonia<br>1% nonionic wetting agent | 1 hour |
| | Leave overnight<br>Run 30' - Drain | |
| Dyeing: | 250% water<br>1% Ammonia | 15' |
| | 2% Vernaminol liquor ASN<br>2% Vernol liquor SL<br>10% water | 30' |
| | 4% dye<br>30% water | 30' |
| | 2% Formic acid<br>20% Water | 5', 5', 20' |
| | 2% dye<br>30% water | 30' |
| | 150% water<br>0.5% Formic Acid | 20' |
| | Drain, pile overnight<br>Lightly set, hook dry, saw dust, stake, dry drum 4 hours toggle. | |

In the case of experiment, process up to neutralisation was the same as for control. Rest of the process was as follows:

Polymer dispersion of Example 1 replaces 50% Basyntan DI and 100% wattle extract

| | |
|---|---|
| 30% Water<br>4% Lipoderm FBII<br>2% Vernaminol liquor ASN<br>2% Vernol liquor SL<br>10% TUF salt | 2 hours |
| 2% Basyntan DI<br>20% Water | 45' |
| 2% Syntan ACR<br>20% Water | 45' |
| Check exhaust | |
| If not exhausted add 10% solution of formic acid. Rest of the process of crusting, wetting back, dyeing etc. were as for control. | |

The control and experimental leathers were visually examined, physical tested and chemically analysed. The results are shown in Table 1.

EXAMPLE 12

Shoe suedes from wet blue buffalo splits.

Starting material: Wet blue buff splits. Shave to 1.0 mm substance. (Based on shaved weight).

| | | |
|---|---|---|
| Rechroming | 50% Water<br>5% Chrome extract<br>(50% Basicity)<br>adjust pH to 4.0 | 1 hour |
| Washing | | |
| I wash | 100% water - 15' | |
| II wash | 100% water - 15' | |
| Neutralisation | 150% water<br>1% Vernatan AKM<br>10% water | 15' |
| | 1% Sodium bicarbonate<br>10% water | 15', 15, 15' |
| | pH at cut section 5.5 | |
| Washing | | |
| I wash | 100% water - 15' | |
| II wash | 100% water at 55° C. - 15' | |
| Retanning & Fatliquoring | 40% water at 55° C.<br>4% Vernol liquor SF<br>4% Vernaminol liquor ASN<br>20% water | 45' |
| | 8% wattle extract<br>10% water | 45' |
| | 4% Basyntan DI<br>10% water | 45' |
| | 1% Formic acid<br>10% water | 5', 5', 20' |
| | Pile overnight, lightly set, hook dry, saw dust, stake, buff on the flesh side with 240, 320, paper. Buff on the side which was in contact with grain with 180 paper. | |
| Experiment | 20% water<br>15% Polymer dispersion of example 1<br>4% Vernaminol liquor ASN<br>4% Vernol liquor SF<br>10% water | 1 hr. |

-continued

| | | |
|---|---|---|
| | 2% Basyntan DI<br>20% water | 45' |
| | 1% Formic Acid<br>10% water | 5', 5', 20' |
| | Polymer dispersion of Example 1 replaces 100% wattle extract and 50% Basyntan DI. Rest of the process was the same as for control. Dyeing (common both for control and experiment). | |
| | 1000% Water<br>1% nonionic wetting agent<br>1% Ammonia | 1 hr. |
| | Leave overnight<br>Rinse 30'Drain<br>Washing 400% water - 30' | |
| Dyeing | 250% Water<br>1% Ammonia | 15' |
| | 1% Tamol NNO (BASF) - 15'<br>10% water | |
| | 4% Vernaminol liquor ASN<br>10% water | 30' |
| | 2% Dye<br>20% water | 30' |
| | 1.5% Formic Acid<br>15% water | 5' 5', 20' |
| | Drain<br>Rinse in | |
| | 150% Water<br>0.5% Formic Acid | 10' |
| | Drain, Pile overnight<br>Set, hook dry, saw dust, stake, dry drum for 4 hours toggle. | |

We claim:

1. An improved process for the chemical treatment of animal skins and hides to obtain leather by tanning, rechroming, retanning and dyeing, each of said steps of tanning, rechroming, retanning and dyeing being carried out in the presence of its respective treating liquor the improved process comprising preparing an aqueous dispersion of microcrystalline polymer and adding the prepared aqueous dispersion to the treating liquor such that at least one of said steps of tanning, rechroming, retanning and dyeing is carried out in the presence of the respective liquor with said aqueous dispersion added thereto to improve chrome absorption, said microcrystalline polymer having particles of size up to 2 microns and selected from a polyamide or polyester and maintaining a pH level between 2 to 8.

2. An improved process as claimed in claim wherein the aqueous dispersion of said polyamide or polyester has solid content of up to 50%.

3. An improved process as claimed in claim 1 wherein the treatment is carried out at a pH between 2 to 4.5.

4. An improved process as claimed in claim 2 wherein the treatment is carried out at a pH between 2 to 4.5.

5. An improved process as claimed in claim 3 wherein the said microcrystalline polymer or polyester is obtained by subjecting chips of the polymer material to attrition in an attrition mill.

6. An improved process as claimed in claim 4 wherein said microcrystalline polymer or polyester is obtained by subjecting chips of the polymer material to attrition in an attrition mill.

* * * * *